US010035052B2

(12) United States Patent
Solheim et al.

(10) Patent No.: US 10,035,052 B2
(45) Date of Patent: Jul. 31, 2018

(54) GOLF CLUB HEADS WITH GROOVES AND METHODS OF MANUFACTURE

(71) Applicant: Karsten Manufacturing Corporation, Phoenix, AZ (US)

(72) Inventors: John A. Solheim, Phoenix, AZ (US); David L. Petersen, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/407,335

(22) Filed: Jan. 17, 2017

(65) Prior Publication Data

US 2017/0120113 A1 May 4, 2017

Related U.S. Application Data

(60) Continuation of application No. 14/453,495, filed on Aug. 6, 2014, now Pat. No. 9,597,557, which is a division of application No. 12/543,356, filed on Aug. 18, 2009, now Pat. No. 8,814,720, and a continuation-in-part of application No. 12/034,065, filed on Feb. 20, 2008, now Pat. No. 7,780,548.

(60) Provisional application No. 61/089,851, filed on Aug. 18, 2008.

(51) Int. Cl.
*A63B 53/04* (2015.01)

(52) U.S. Cl.
CPC .... *A63B 53/047* (2013.01); *A63B 2053/0408* (2013.01); *A63B 2053/0445* (2013.01)

(58) Field of Classification Search
USPC ..... 473/324–350
See application file for complete search history.

(56) References Cited

U.S. PATENT DOCUMENTS

| | | | |
|---|---|---|---|
| 1,536,616 | A | 5/1925 | Manning |
| 4,200,606 | A | 4/1980 | Kitko |
| 4,768,787 | A | 9/1988 | Shira |
| 4,902,016 | A | 2/1990 | Boone |
| 4,964,641 | A | 10/1990 | Miesch et al. |
| 5,037,102 | A | 8/1991 | Fukayama et al. |
| 5,437,088 | A | 8/1995 | Igarashi |
| 5,591,092 | A | 1/1997 | Gilbert |
| 5,595,547 | A | 1/1997 | Lekavich |
| 5,618,239 | A | 4/1997 | Rife |
| 5,637,044 | A | 6/1997 | Swash |

(Continued)

FOREIGN PATENT DOCUMENTS

| | | |
|---|---|---|
| EP | 1234602 | 8/2002 |
| JP | 10179824 | 7/1998 |

(Continued)

OTHER PUBLICATIONS

Notice to Manufacturers: New Groove Regulations, dated Feb. 27, 2007; http://www.usga.org/equipment/notices/new_groove_regulations.html/ Aug. 20, 2007; 3 pages Feb. 27, 2007.

(Continued)

*Primary Examiner* — Alvin Hunter

(57) ABSTRACT

Embodiments of golf clubs, golf club heads, and methods of manufacture are described herein. In one embodiment, a golf club head includes a strike face having one or more grooves with edges, where one or more of the edges is unsmooth. Other embodiments are also described herein.

19 Claims, 11 Drawing Sheets

(56) References Cited

U.S. PATENT DOCUMENTS

| | | | | |
|---|---|---|---|---|
| 6,733,400 | B2 | 5/2004 | Sherwood | |
| 6,814,673 | B2 | 11/2004 | Wahl et al. | |
| 6,849,004 | B2 | 2/2005 | Lindsay | |
| 6,981,923 | B2 | 1/2006 | Chappell | |
| 7,056,226 | B2 | 6/2006 | Kennedy | |
| 7,066,833 | B2 | 6/2006 | Yamamoto | |
| 7,156,751 | B2 | 1/2007 | Wahl et al. | |
| 7,179,175 | B2 | 2/2007 | Kennedy, III | |
| 7,275,999 | B2 | 10/2007 | Sherwood | |
| RE40,874 | E | 8/2009 | Wahl et al. | |
| 7,568,983 | B2 | 8/2009 | Gilbert | |
| 7,594,863 | B2 | 9/2009 | Ban | |
| 7,780,548 | B2 | 8/2010 | Solheim | |
| 8,105,180 | B1 | 1/2012 | Cackett | |
| 8,602,911 | B2 | 12/2013 | Solheim | |
| 9,597,557 | B2 * | 3/2017 | Solheim | A63B 53/047 |
| 2004/0087387 | A1 | 5/2004 | Wahl et al. | |
| 2004/0192460 | A1 | 9/2004 | Sherwood | |
| 2005/0043113 | A1 | 2/2005 | Mann, Jr. et al. | |
| 2005/0130761 | A1 | 6/2005 | Vokey et al. | |
| 2005/0143187 | A1 | 6/2005 | Kennedy | |
| 2007/0078027 | A1 | 4/2007 | Wong | |
| 2007/0082752 | A1 | 4/2007 | Boyd | |
| 2007/0149312 | A1 | 6/2007 | Gilbert | |
| 2008/0039230 | A1 | 2/2008 | Lin et al. | |
| 2009/0036228 | A1 | 2/2009 | Ban et al. | |
| 2009/0082129 | A1 | 3/2009 | Ban et al. | |
| 2009/0143165 | A1 | 6/2009 | Ban et al. | |
| 2009/0247318 | A1 | 10/2009 | Ban et al. | |
| 2009/0325728 | A1 | 12/2009 | Solheim et al. | |
| 2010/0056295 | A1 | 3/2010 | Ban et al. | |

FOREIGN PATENT DOCUMENTS

| | | |
|---|---|---|
| JP | 10179825 | 7/1998 |
| JP | 10249874 | 9/1998 |
| JP | 2000254261 | 9/2000 |
| JP | 2000296191 | 10/2000 |
| JP | 2002065911 | 3/2002 |
| JP | 2002239040 | 8/2002 |
| JP | 2004136030 | 5/2004 |
| JP | 2009034393 | 2/2009 |
| JP | 2009178257 | 8/2009 |
| WO | 02085462 | 10/2002 |
| WO | 2006015420 | 2/2006 |

OTHER PUBLICATIONS

Current Rule / Proposed Rule; http://www.usga.org/equipment/notices/PROPOSED%2OGROOVE%WPRULE.pdf; Aug. 20, 2007; 3 pages Aug. 20, 2007.

Groove Measurement Procedure Outline; http://www.usga.org/equipment/notices/Groove%20Measurement%20Procedure%20Outline.pdf; Aug. 20, 2007; 9 pages Aug. 20, 2007.

USGA Announces Rules Changes on Golf Club Grooves, dated Aug. 6, 2008, Your Daily Golf Transaction Newsletter The Wire, 3 pages Aug. 6, 2008.

Determination of Groove Conformance, Aug. 2008, 9 pages Aug. 1, 2008.

USGA: Notice to Manufacturers, New Groove Regulations, Aug. 5, 2008, 3 pages Aug. 5, 2008.

* cited by examiner

Fig. 1
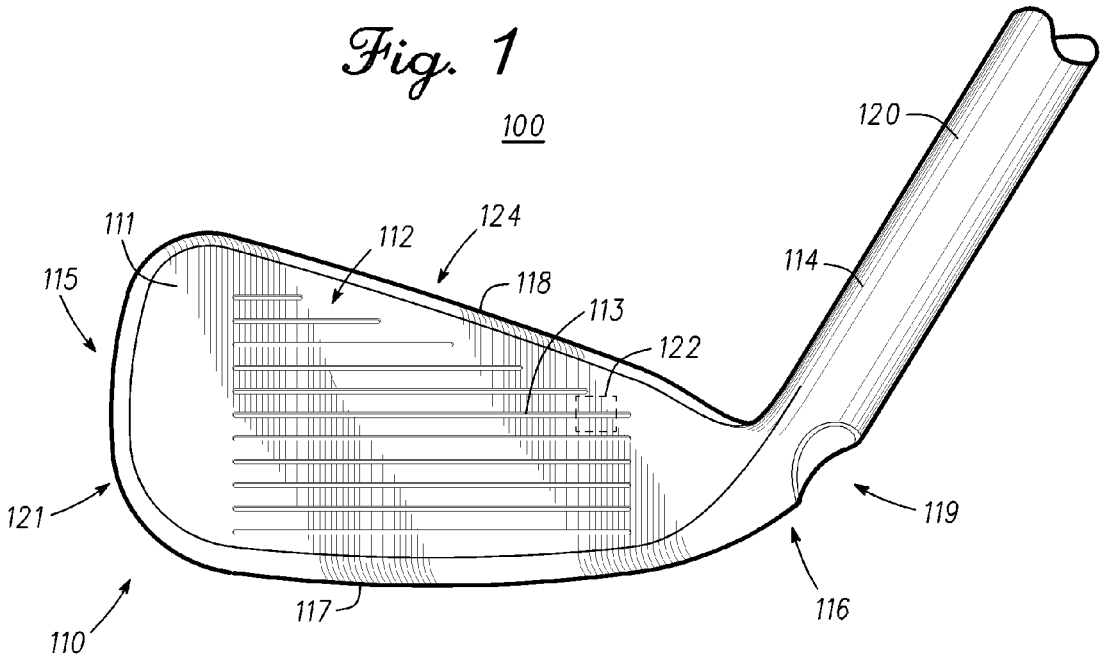
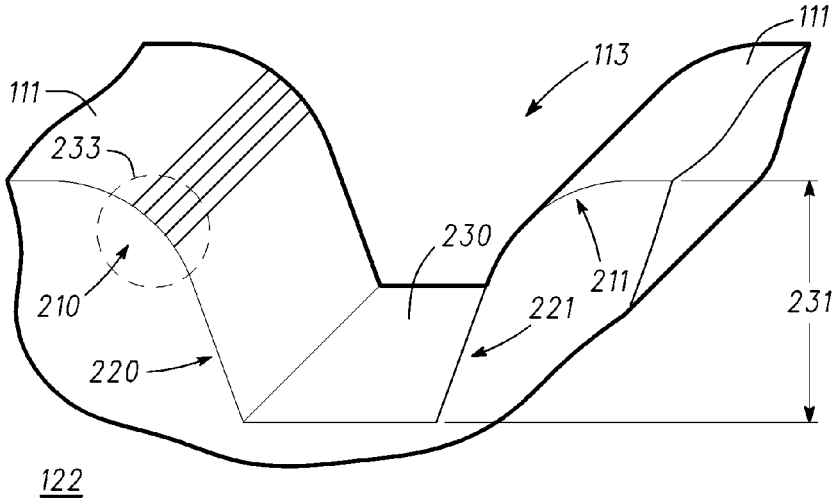
Fig. 2

Fig. 3
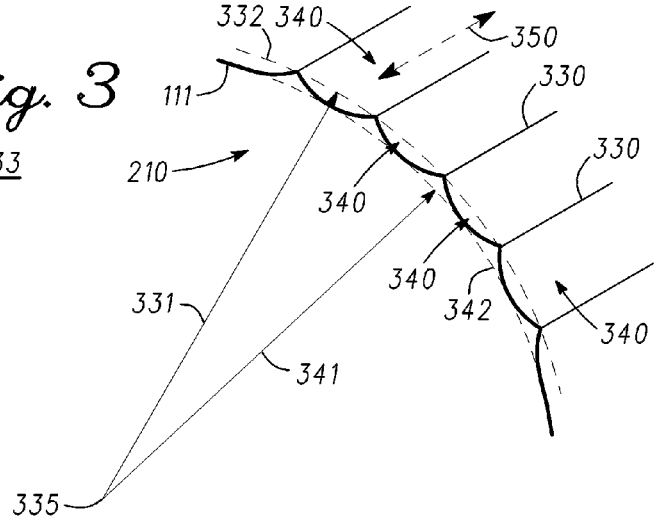
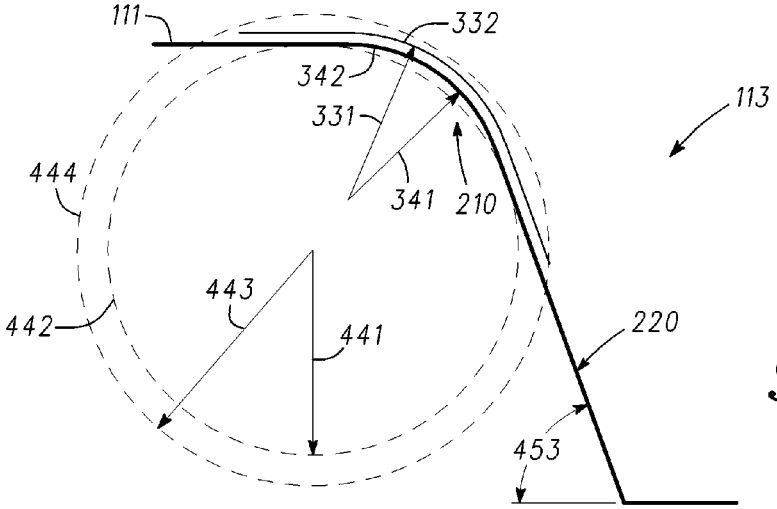
Fig. 4
Fig. 5
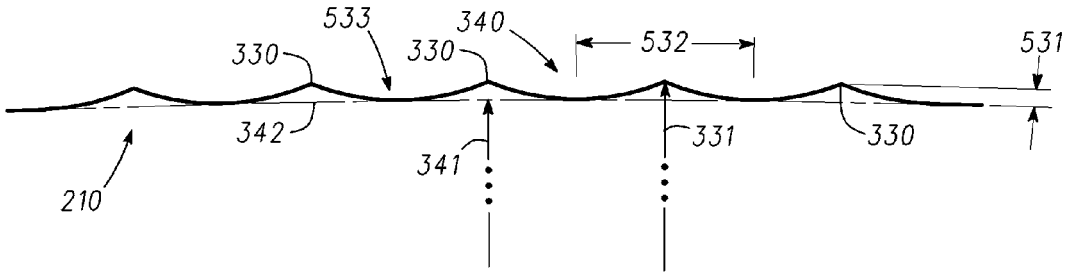

Fig. 21
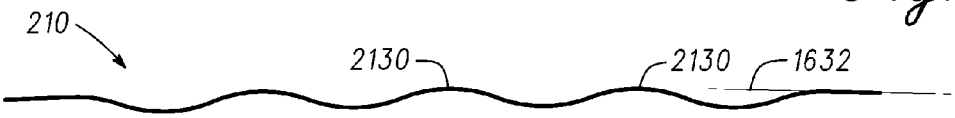
Fig. 22
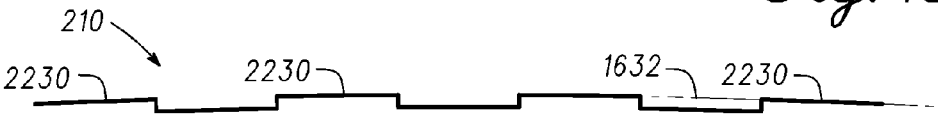
Fig. 23
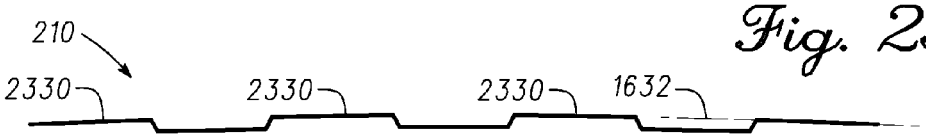
Fig. 24
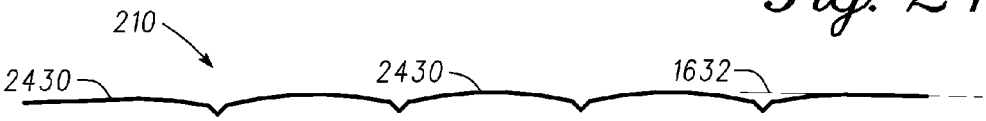
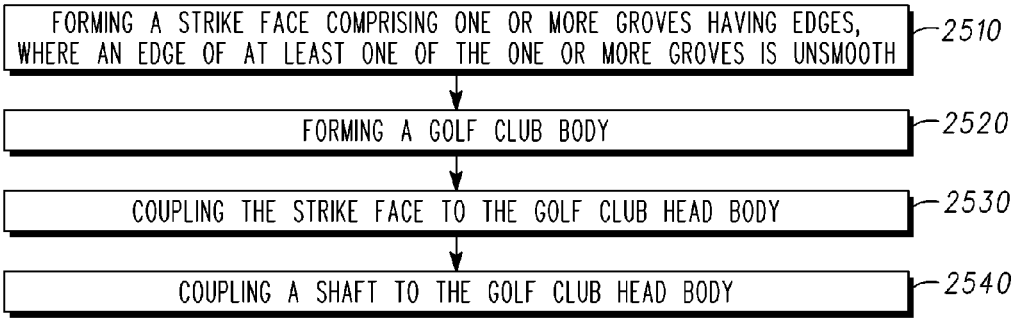
Fig. 25 2500

GOLF CLUB HEADS WITH GROOVES AND METHODS OF MANUFACTURE

CROSS-REFERENCE TO RELATED APPLICATIONS

This is a continuation of U.S. Non-Provisional patent application Ser. No. 14/453,495, filed Aug. 6, 2014, which is a divisional of U.S. Non-Provisional patent application Ser. No. 12/543,356, filed Aug. 18, 2009, which claims the benefit of U.S. Provisional Patent Application No. 61/089,851, filed Aug. 18, 2008, and is a continuation-in-part of U.S. Non-Provisional patent application Ser. No. 12/034,065, which was filed on Feb. 20, 2008, and issued as U.S. Pat. No. 7,780,548 on Aug. 24, 2010. The entire contents of which mentioned above are incorporated fully herein by reference.

TECHNICAL FIELD

This disclosure relates generally to golf clubs, and relates more particularly to golf club heads with grooves and their methods of manufacturing.

BACKGROUND

Typically, a golf club head can include a club face with a plurality of parallel grooves extending between a toe end and a heel end of the club face. In particular, the plurality of grooves in an iron-type club head can channel out water, sand, grass, and/or other debris that may come between a golf ball and the club face in order to improve the grip between the golf ball and the club face. The grooves can have various cross-sectional shapes such as a square or rectangular shape, a V-shape, or a U shape.

DESCRIPTION OF THE DRAWINGS

FIG. 1 depicts a front view of a golf club, according to a first embodiment;

FIG. 2 depicts a cross-sectional view of a portion of a groove of the golf club of FIG. 1, as defined by dashed region 122 in FIG. 1;

FIG. 3 depicts a portion of an edge of the groove of FIG. 2, as defined by dashed region 233 in FIG. 2;

FIG. 4 depicts a measurement of the edge of the groove of FIGS. 2 and 3;

FIG. 5 depicts a first simplified representation of a portion of the edge of FIG. 3, according to the first embodiment;

FIG. 21 depicts a simplified representation of a portion of the edge of FIG. 16, according to a fourteenth embodiment;

FIG. 22 depicts a simplified representation of a portion of the edge of FIG. 16, according to a fifteenth embodiment;

FIG. 23 depicts a simplified representation of a portion of the edge of FIG. 16, according to a sixteenth embodiment;

FIG. 24 depicts a simplified representation of a portion of the edge of FIG. 16, according to a seventeenth embodiment;

FIG. 25 depicts a method of manufacturing a golf club, according to an eighteenth embodiment;

Figure 6:
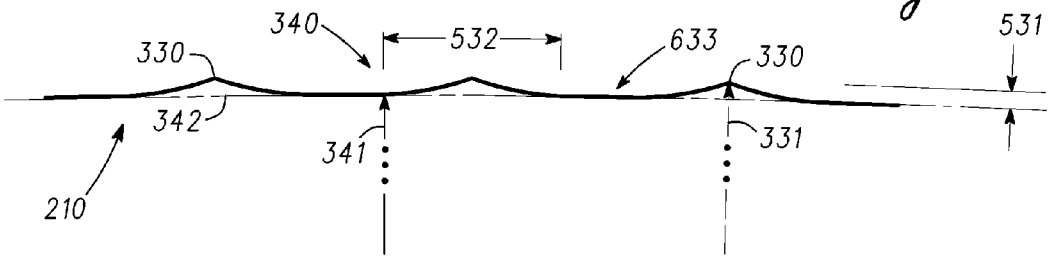
FIG. 6 depicts a second simplified representation of a portion of the edge of FIG. 3, according to a second embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in physically, mechanical, or other manner.

DESCRIPTION OF EXEMPLARY EMBODIMENTS

Some embodiments include a method of manufacturing a golf club head. The method can comprise: providing a strike face; and forming one or more grooves at the strike face. The one or more grooves can have edges, and one or more of the edges can be unsmooth.

Further embodiments include a method of manufacturing a golf club head. The method can comprise: providing a strike face; and forming one or more grooves at the strike face. The one or more grooves can have edges, and one or more of the edges can be unsmooth. Meanwhile, forming the one or more grooves at the strike face can comprise: forming one or more protrusions of the one or more edges; and forming sidewalls of the one or more grooves adjacent to the edges. Also, the one or more protrusions are located at the edges and are absent from the sidewalls, the one or more protrusions extend from the one or more edges by up to approximately 0.033 millimeters, and/or the one or more edges have an effective radius greater than or equal to approximately 1.016 millimeters.

Other embodiments include a method of manufacturing a golf club head. The method can comprise forming a strike face comprising one or more grooves having edges. At least one of the edges of at least one of the one or more grooves can be unsmooth, and the at least one of the edges comprises two or more protrusions having a maximum height of approximately 0.033 millimeters.

In one embodiment of golf club heads and methods of manufacture, a golf club head includes a strike face including one or more grooves with edges, where one or more of the edges is unsmooth and includes at least one machining mark or other protrusion having a maximum height from the edge of about 0.033 millimeters or 0.0013 inches. Other embodiments of golf clubs and methods of manufacture are also disclosed herein.

Turning now to the figures, FIG. 1 depicts a front view of golf club 100, according to a first embodiment. Golf club 100 can be an iron-type golf club head, such as a 1-iron, a 2-iron, a 3-iron, a 4-iron, a 5-iron, a 6-iron, a 7-iron, an 8-iron, a 9-iron, a sand wedge, a lob wedge, a pitching wedge, an n-degree wedge (e.g., 44 degrees (°), 48°, 52°, 56°, 60°, etc.), etc.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Golf club 100 includes golf club head body 110 and shaft 120 coupled to golf club head body 110. In the illustrated embodiment of FIG. 1, golf club head body 110 includes hosel 114 to which shaft 120 is coupled. In a different embodiment, golf club head body 110 has a hole, instead of hosel 114, to which shaft 120 is coupled.

Golf club head body 110 includes toe portion 115 and heel portion 116, where hosel 114 is located at heel portion 116. Golf club head body 110 also includes a perimeter 121 comprising sole 117 at a bottom portion of golf club head body 110 and also comprising top rail 118 at a top portion of golf club head body 110. Golf club head body 110 can also include notch 119 at heel portion 116.

Golf club head body 110 further includes back face 124 and front face 111 opposite back face 124. Front face 111 can also be referred to as a strike face. The strike face can be an integral part of golf club head body 110, or the strike face can be a separate piece from, or an insert for, golf club head body 110. The strike face includes one or more grooves 112, including groove 113. Groove 113 can be referred to as a channel, and grooves 112 can be referred to as channels. Grooves 112 can extend across the strike face from toe portion 115 of golf club head body 110 to heel portion 116 of golf club head body 110. Grooves 112 can also be stacked vertically above one another from sole 117 to top rail 118.

In one embodiment, grooves 112, including groove 113: (1) are straight and parallel with each other; (2) have a symmetrical cross-section and have sidewalls that do not converge toward the groove opening; (3) have a width, spacing, and cross-section that is consistent throughout the impact area of front face 111; (4) have a width that does not exceed 0.940 millimeters (mm) or 0.037 inches (in.) using the United States Golf Association's (USGA's) thirty degree method of measurement, and where less than half of the widths of grooves 112 exceed 0.889 mm or 0.035 in. using the same measurement technique; (5) have a distance between adjacent grooves that is not less than three times the maximum width of the adjacent grooves minus 0.203 mm or 0.008 in. and that is not less than 1.854 mm or 0.073 in., and where less than half of the distances between adjacent ones of grooves 112 are less than three times the maximum width of the adjacent grooves and are less than 1.905 mm or 0.075 in.; (6) have a depth that does not exceed 0.559 mm or 0.022 in., and where less than half of the depths of grooves 112 exceed 0.508 mm or 0.020 in.; (7) have a cross-sectional area divided by a groove pitch (i.e., groove width plus spacing between adjacent grooves) that does not exceed 0.0813 mm or 0.0032 in., and where the less than half of the cross-sectional areas divided by the respective groove pitches exceed 0.0762 mm or 0.0030 in.; (8) have a range of widths that do not exceed 0.254 mm or 0.010 in.; and (9)

have a range of depths that do not exceed 0.254 mm or 0.010 in. Additional details regarding grooves 112 are explained in the subsequent figures.

FIG. 2 depicts a cross-sectional view of a portion of groove 113 of golf club head body 110 (FIG. 1). The cross-sectional view of FIG. 2 is defined by dashed region 122 in FIG. 1. As depicted in FIG. 2, groove 113 has edges 210 and 211, sidewalls 220 and 221, and bottom 230. Edge 210 is adjacent to and couples front face 111 and sidewall 220, and edge 211 is adjacent to and couples front face 111 and sidewall 221. Bottom 230 is adjacent to and couples sidewalls 220 and 211. Edges 210 and 211 can also be referred to as borders. Groove 113 has depth 231, as defined by a substantially perpendicular distance between front face 111 and bottom 230.

Groove 113 can have a variety of overall cross-sectional shapes including, but not limited to, a U-shape, a V-shape, a rectangular-shape, a square-shape, and the like. In the embodiment illustrated in FIG. 2, groove 113 is symmetric such that edges 210 and 211 are substantially mirror images of each other, sidewalls 220 and 221 are substantially mirror images of each other, and the left and right halves of bottom 230 are substantially mirror images of each other. In a different embodiment, groove 113 can be asymmetric such that edges 210 and 211 are different from each other, sidewalls 220 and 221 are different from each other, and/or the left and right halves of bottom 230 are different from each other.

Turning to FIG. 3, a portion of edge 210 is depicted. The portion of FIG. 3 is defined by dashed region 233 in FIG. 2. As depicted in FIG. 3, edge 210 has an overall convex curve shape. Within that overall shape, however, edge 210 is unsmooth or uneven because edge 210 comprises one or more machining marks 330, which do not include the overall shape of edge 210. Also, FIG. 3 illustrates edge 210 to include five of machining marks 330, but edge 210 can include more or less than five of machining marks 330. Furthermore, machining marks 330 have peaks or peak points that remain below front face 111 and do not extend out of groove 113 (FIG. 2), but in a different embodiment, the peaks do not remain below front face 111 and/or do extend out of groove 113 (FIG. 2). In one embodiment, the peaks of machining marks 330 do not create an overall sharpness for edge 210, as best seen in FIG. 2. Additional details regarding machining marks 330 are described below.

Referring briefly back to the embodiment depicted in FIG. 2, the machining marks at edge 210 do not form a raised lip or a sharp edge for edge 210 or groove 113. Also, edge 211 is symmetric with edge 210 such that edge 211 is also unsmooth in the same manner as edge 210. In a different embodiment, edge 211 is unsmooth in a different manner than edge 210 (i.e., a different number, shape, or size of machining marks).

In another embodiment, still referring to FIG. 2, edge 211 is smooth while edge 210 is unsmooth. In this embodiment, the bottom edges of grooves 112 (FIG. 1) (i.e., the edges of a groove that are closer to sole 117 of golf club head body 110) can be smooth while the top edges of grooves 112 (FIG. 1) (i.e., the edges of a groove that are closer to top rail 118 of golf club head body 110) can be unsmooth.

In a further embodiment, edge 211 is unsmooth while edge 210 is smooth. In this embodiment, the bottom edges of grooves 112 (FIG. 1) can be unsmooth while the top edges of grooves 112 (FIG. 1) can be smooth.

The unsmooth or uneven characteristic of edge 210 (and/or edge 211 (FIG. 2)) can be defined by, as one example, two or more inflection points. The unsmooth or uneven characteristic of edge 210 can produce a sharp corner for edge 210, or the unsmooth or uneven characteristic of edge 210 can produce a non-sharp or even a dull corner for edge 210.

The unsmooth or uneven characteristic of edge 210 and/or edge 211 can, under certain conditions, increase the grip that front face 111 (FIG. 1) has on a golf ball when front face 111 of golf club head body 110 (FIG. 1) impacts the golf ball. As a result of the increased or improved grip, the golf ball can, under certain conditions, have a higher rate of backspin, which can, under certain conditions, improve the consistency of a golf shot from golf club 100 (FIG. 1) in a variety of playing conditions.

As also depicted in FIGS. 2 and 3, machining marks 330 are located at edge 210 and/or edge 211, but are absent from sidewalls 220 and 221. In a different embodiment, machining marks 330 can also be located at one or both of sidewalls 220 and 221. This different embodiment can be useful if front face 111 and/or edges 210 and 211 are soft or otherwise deformable so that machining marks 330 at sidewalls 220 and 221 can grip the golf ball when front face 111 impacts the golf ball.

Machining marks 330 can also be referred to as projections and can include protuberances, extensions, and undulations. As best seen in FIGS. 2 and 3, machining marks 330 can be substantially parallel to groove 113. Accordingly, in an embodiment where each edge of grooves 112 (FIG. 1) have machining marks 330, each of machining marks 330 can be parallel to each of grooves 112.

Machining marks 330 can be regularly or irregularly shaped. Machining marks 330 can also be symmetric (vertically, horizontally, or otherwise) such that a first half of a machining mark is substantially a mirror image of a second half of the same machining mark, or machining mark 330 can be asymmetric such that a first half of a machining mark is different from a second half of the same machining mark. Machining marks 330 can further be symmetric such that a first one of machining marks 330 is substantially a mirror image of a second one of machining marks 330, or machining marks 330 can be asymmetric such that a first one of machining marks 330 is different from a second one of machining marks 330.

Machining marks 330 have peaks and concave sides. The concave sides between adjacent machining marks 330 define valleys 340. Accordingly, machining marks 330 can have a scallop-like configuration, as depicted in FIG. 3, but other configurations are also contemplated, as shown in the subsequent figures.

The peaks of machining marks 330 in FIG. 3 define curve 332. Curve 332 is represented by a dashed line in FIG. 3, and curve 332 has a radius 331. Similarly, the bottom portions of valleys 340 define curve 342. Curve 342 is represented by another dashed line in FIG. 3, and curve 342 has radius 341. As depicted in FIG. 3, curves 332 and 342 are concentric or parallel with each other; radii 331 and 341 originate from the same point 335; and radius 341 is smaller than radius 331. In one embodiment, each of radius 331 and radius 341 is greater than or equal to approximately 0.254 mm or 0.01 in. In another embodiment, each of radius 331 and radius 341 is greater than or equal to approximately 1.016 mm or 0.04 in. Either one or both of radius 331 and radius 341 can be referred to as an effective radius of edge 210, and in the same or different embodiment, each edge of grooves 112 (FIG. 1) can have radius 331 and radius 341, or only one edge of each of grooves 112 (FIG. 1) can have radius 331 and radius 341 while the other edge of each of grooves 112 (FIG. 1) has radius 341. In one embodiment, the height of the machining marks, as measured from curve 342 to curve 332, is approximately 0.0127 mm to 0.0508 mm or 0.0005 in to 0.002 in. In this embodiment, the difference between radius 331 and radius 341 is within the same range of approximately 0.0127 mm to 0.0508 mm or 0.0005 in. to 0.002 in.

Referring back to FIG. 1, one or more other ones of grooves 112 can be similar, identical, or symmetric to groove 113. In one embodiment, groove 113 is asymmetric, but each of grooves 112 is symmetric with groove 113. As another example, in another embodiment, groove 113 is symmetric, and every second one or every third one of grooves 112 is symmetric with groove 113. In this embodiment, the ones of grooves 112 that are not symmetric to groove 113 can have a different cross-sectional shape, one smooth edge and one unsmooth edge, one or two edges with a different number of machining marks, a different shape of machining marks, and/or a different height or width of machining marks. Other variations are also contemplated herein.

Turning to FIG. 4, a previously proposed USGA measurement of the sharpness of edge 210 of groove 113 of FIGS. 2 and 3 is depicted. In particular, FIG. 4 shows two dashed concentric circles 442 and 444 having radii 441 and 443, respectively. The smaller circle, circle 442, is tangential to front face 111 and to sidewall 220, and sidewall 220 has an angle 453.

In one embodiment, edge 210 is not sharp where:

$$radius_{341} \geq radius_{441} + \frac{radius_{443} - radius_{441}}{\left(1 - \frac{\sqrt{2}}{\sin(angle_{453})}\sqrt{1 - \cos(angle_{453})}\right)} \quad \text{(Eq. 1)}$$

and $$radius_{331} \geq radius_{441} + \frac{radius_{443} - radius_{441}}{\left(1 - \frac{\sqrt{2}}{\sin(angle_{453})}\sqrt{1 - \cos(angle_{453})}\right)}. \quad \text{(Eq. 2)}$$

In the same or a different embodiment, radius 441 has a length of 0.254 mm or 0.01 in., and radius 443 has a length of 0.279 mm or 0.011 in. In another embodiment, radius 441 has a length of 0.508 mm or 0.020 in., and radius 443 has a length of 0.533 mm or 0.021 in. In the same or other embodiments, radius 441 has a length that is from 0.254 mm to 0.508 mm or 0.010 in. to 0.020 in., and radius 443 has a length that is from 0.279 mm to 0.533 mm or 0.011 in. to 0.021 in.

In one embodiment, edge 210 can be defined by the portion of groove 113 that is located within circles 442 and 444. In the same or different embodiment, edge 210 is defined as being located between front face 111 and sidewall 220. In one example of this embodiment, front face 111 and sidewall 220 can be flat such that edge 210 is the non-flat portion located between the flat surfaces of front face 111 and sidewall 220. Other configurations for edge 210 are also contemplated herein.

Referring back to FIG. 3, machining marks 330 protrude or extend from edge 210. Arrow 350 shows a direction that a drill bit or micromachining tool can move along edge 210 to form valleys 340 and machining marks 330 after casting, forging, machining, or otherwise forming front face 111 and/or golf club head body 110 (FIG. 1). In one embodiment, each of valleys 340 represents a single cut or pass of a micromachining tool along edge 210. In a different embodiment, a single cut or pass of a micromachining tool along edge 210 can simultaneously form two or more of valleys 340.

FIG. 5 depicts a first simplified representation of a portion of edge 210 of FIG. 3, according to the first embodiment. FIG. 5 is a simplified representation because, in part, the overall shape of edge 210 is not shown to be curved, as depicted in FIG. 3. Also, FIG. 5 shows only a portion of edge 210.

Each of machining marks 330 has a width 532, which is less than a width of groove 113 (FIG. 2). Each of machining marks 330 also have a height 531 above edge 210. Height 531 is the difference between radius 331 and 341, and therefore, height 531 is measured radially from edge 210. Height 531 of machining marks 330 is less than depth 231 (FIG. 2) of groove 113 (FIG. 2). In one embodiment, distance 531 is up to approximately 0.0254 mm or 0.001 in. In the same embodiment, width 532 is approximately 0.254 mm or 0.01 in. or greater, and the ratio of distance 531 to width 532 can be approximately 1:10 or greater. In the same or a different embodiment, distance 531 is up to approximately ten percent of radius 331 and/or radius 341. In another embodiment, width 532 can be less than 0.254 mm or 0.01 in., and/or distance 531 can be greater than 0.0254 mm or 0.001 in.

As also depicted in FIG. 5, portions 533 of edge 210 located between two adjacent ones of machining marks 330 are substantially smooth, substantially uniform, and substantially curved. The curves are depicted to be concave, but in another embodiment, the curve can be convex.

FIG. 6 depicts a second simplified representation of a portion of edge 210 of FIG. 3, according to a second embodiment. FIG. 6 is similar to FIG. 5, except that adjacent ones of machining marks 330 in FIG. 6 are spaced apart from each other by portions 633 of edge 210. As an example, portions 633 can space apart adjacent ones of machining marks 330 by a distance of up to approximately 0.3 mm or 0.012 in. In one embodiment, adjacent ones of machining marks 330 can be separated from each other by the same distance, or by different distances. In contrast, the distance between adjacent ones of machining marks 330 in FIG. 5 is substantially zero. Portions 633 in FIG. 6 can be substantially planar, or can be convexly or concavely curved or can have a different configuration.

Figure 7:
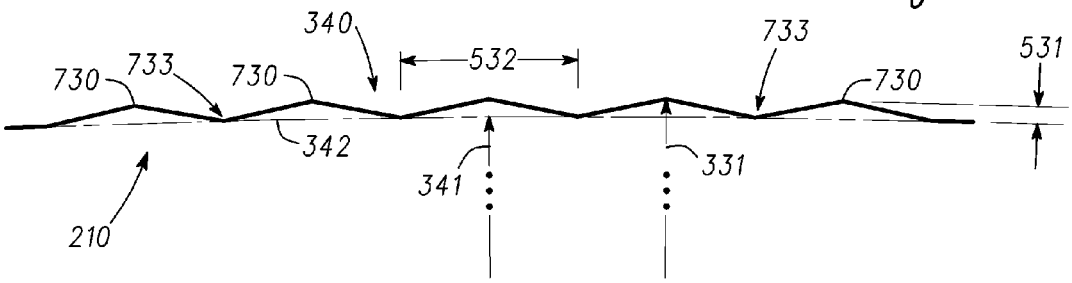
FIG. 7 depicts a third simplified representation of a portion of the edge of FIG. 3, according to a third embodiment.

FIG. 7 depicts a third simplified representation of a portion of edge 210 of FIG. 3, according to a third embodiment. FIG. 7 is similar to FIG. 5, except that FIG. 7 depicts machining marks 730, which have substantially straight sides instead of the concave sides of machining marks 330 in FIG. 5. Also, in FIG. 7, portions 733 of edge 210 are located between adjacent ones of machining marks 730 and have an overall V-shape.

Figure 8:
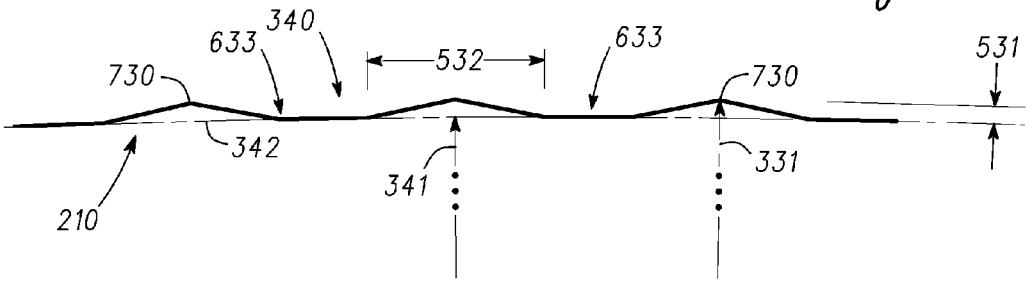
FIG. 8 depicts a fourth simplified representation of a portion of the edge of FIG. 3, according to a fourth embodiment.

FIG. 8 depicts a fourth simplified representation of a portion of edge 210 of FIG. 3, according to a fourth embodiment. FIG. 8 is similar to FIG. 7, except that adjacent ones of machining marks 730 in FIG. 8 are spaced apart from each other by portions 633 of edge 210.

Figure 9:
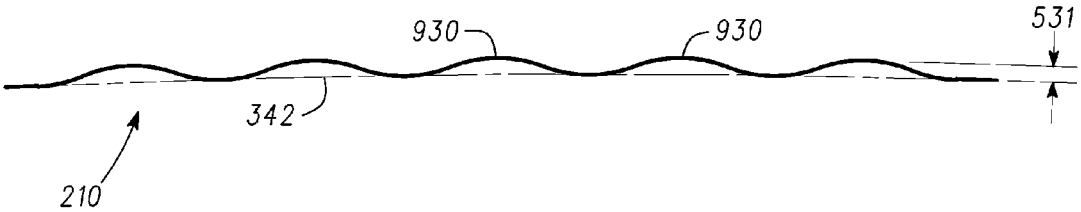
FIG. 9 depicts a fifth simplified representation of a portion of the edge of FIG. 3, according to a fifth embodiment.

FIG. 9 depicts a fifth simplified representation of a portion of edge 210 of FIG. 3, according to a fifth embodiment. FIG. 9 is similar to FIG. 5, except that FIG. 9 depicts machining marks 930, which have curved top surfaces or rounded peaks instead of the pointed peaks of machining marks 330 in FIG. 5. In a different embodiment, adjacent ones of machining marks 930 can be separated by portions 633 (FIG. 6) of edge 210.

Figure 10:
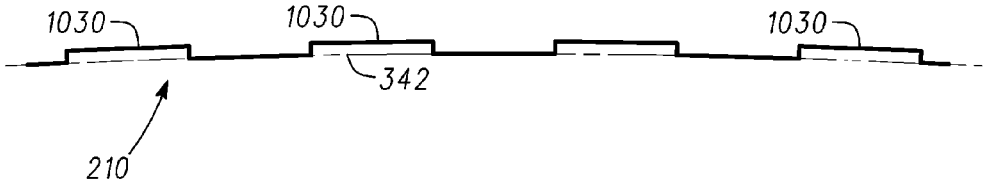
FIG. 10 depicts a sixth simplified representation of a portion of the edge of FIG. 3, according to a sixth embodiment.

FIG. 10 depicts a sixth simplified representation of a portion of edge 210 of FIG. 3, according to a sixth embodiment. FIG. 10 is similar to FIG. 6, except that FIG. 10 depicts machining marks 1030, which are substantially rectangularly shaped and have a substantially planar top surface. In a different embodiment, machining marks 1030 can have rounded top surfaces, which can be concentric or parallel with curve 342.

Figure 11:
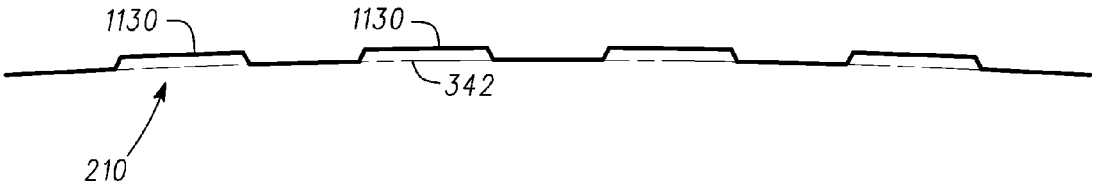
FIG. 11 depicts a seventh simplified representation of a portion of the edge of FIG. 3, according to a seventh embodiment.

FIG. 11 depicts a seventh simplified representation of a portion of edge 210 of FIG. 3, according to a seventh embodiment. FIG. 11 is also similar to FIG. 6, except that FIG. 11 depicts machining marks 1130, which are substantially trapezoidally shaped and have a substantially planar top surface. In a different embodiment, adjacent ones of machining marks 1130 can be contiguous with each other, and/or machining marks 1130 can have rounded top surfaces, which can be concentric or parallel with curve 342.

Figure 12:
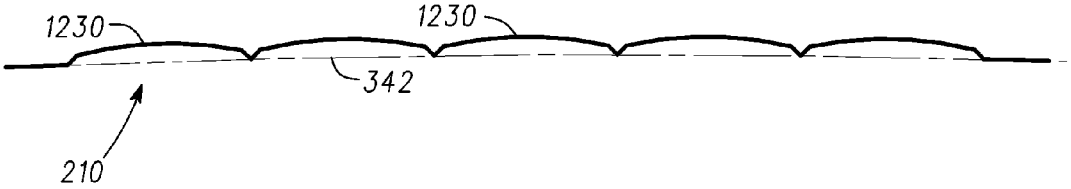
FIG. 12 depicts an eighth simplified representation of a portion of the edge of FIG. 3, according to an eighth embodiment.

FIG. 12 depicts an eighth simplified representation of a portion of edge 210 of FIG. 3, according to an eighth embodiment. FIG. 12 is similar to FIG. 7, except that FIG. 12 depicts machining marks 1230, which have curved top surfaces or rounded peaks. Machining marks 1230 can be vertical combinations of machining marks 730 (FIG. 7) and machining marks 930 (FIG. 9). Other combinations and permutations for the machining marks are also contemplated herein. For example, instead of stacking machining marks 930 above machining marks 730, the machining marks across edge 210 can alternate between machining marks 930 and machining marks 730. As an example, machining marks 1230 can be created by using a drill bit, and a shape that is reversed from what is shown in FIG. 12 can be created by using an electrical discharge machine.

Figure 13:
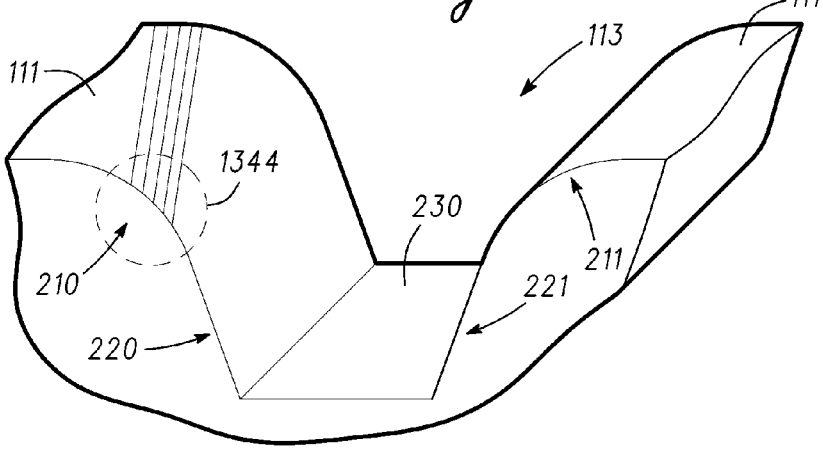
FIG. 13 depicts a second cross-sectional view of the portion of the groove of the golf club of FIG. 1, according to a ninth embodiment, where the cross-sectional view of FIG. 13 is defined by dashed region 122 in FIG. 1.
Figure 14:
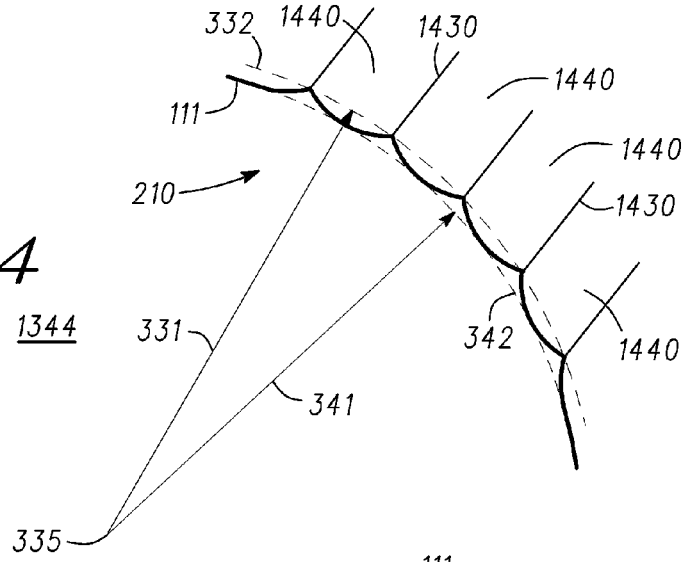
FIG. 14 depicts a portion of an edge of the groove of FIG. 13, according to the ninth embodiment, where the portion of the edge in FIG. 14 is defined by dashed region 1344 in FIG. 13.

FIG. 13 depicts a second cross-sectional view of a portion of groove 113 of golf club 100 of FIG. 1, according to a ninth embodiment, where the cross-sectional view of FIG. 13 is defined by dashed region 122 in FIG. 1. FIG. 14 depicts a portion of edge 210 of FIG. 13, according to the ninth embodiment, where the portion of edge 210 in FIG. 14 is defined by dashed region 1344 in FIG. 13.

FIGS. 13 and 14 are similar to FIGS. 2 and 3, respectively, except that FIGS. 13 and 14 depict machining marks 1430 and valleys 1440 to not be substantially parallel to groove 113 while FIGS. 2 and 3 depict machining marks 330 and valleys 340 to be substantially parallel to groove 113. Except for their non-parallel orientation, machining marks 1430 and valleys 1440 in FIGS. 13 and 14 can be similar to machining marks 330 and valleys 340 in FIGS. 2 and 3. Also, FIG. 14 illustrates edge 210 to include five of machining marks 1430, but edge 210 can include more or less than five of machining marks 1430.

Although machining marks 1430 are not parallel to groove 113, machining marks 1430 can be perpendicular to the direction of the golf ball when front face 111 (FIG. 1) of golf club head body 110 (FIG. 1) is "open" or otherwise "misaligned" during impact of front face 111 with the golf ball. Machining marks 1430 can have the different variations described with reference to FIGS. 5-12. In a different embodiment, the machining marks can be slanted in an opposite direction than depicted in FIG. 13 such that the machining marks are substantially perpendicular to the direction of the golf ball when front face 111 (FIG. 1) of the golf club head body 110 (FIG. 1) is "closed" during impact of front face 111 with the golf ball. Other variations for the machining marks are also contemplated herein.

Figure 15:
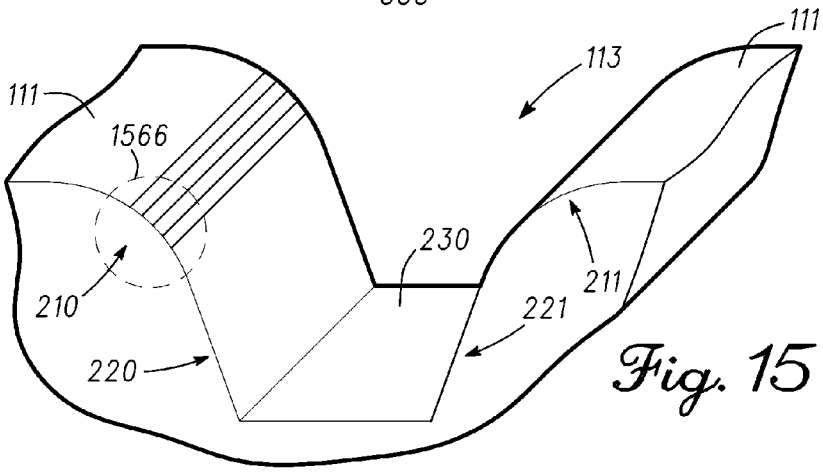
FIG. 15 depicts a third cross-sectional view of the portion of the groove of the golf club of FIG. 1, according to a tenth embodiment, where the cross-sectional view of FIG. 15 is defined by dashed region 122 in FIG. 1.
Figure 16:
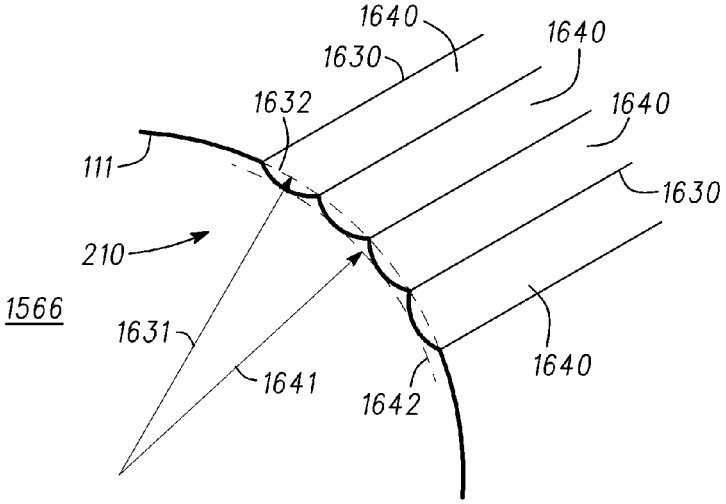
FIG. 16 depicts a portion of an edge of the groove of FIG. 15, according to the tenth embodiment, where the portion of the edge in FIG. 16 is defined by dashed region 1566 in FIG. 15.

FIG. 15 depicts a third cross-sectional view of a portion of groove 113 of golf club 100 of FIG. 1, according to a tenth embodiment, where the cross-sectional view of FIG. 15 is defined by dashed region 122 in FIG. 1. FIG. 16 depicts a portion of edge 210 of FIG. 15, according to the tenth embodiment, where the portion of edge 210 in FIG. 16 is defined by dashed region 1566 in FIG. 15.

FIGS. 15 and 16 are similar to FIGS. 2 and 3, respectively, except that the peaks of machining marks 1630 in FIG. 16 do not extend out or otherwise enlarge a radius of edge 210, as shown in FIGS. 3, 5-12, and 14. Instead, the bottoms of valleys 1640 extend into or reduce a radius of edge 210. Therefore, machining marks 1630 and valleys 1640 in FIG. 16 are formed using a different process than used to form machining marks 330 and valleys 340 in FIG. 3. In particular, valleys 1640 in FIG. 16 are formed as depressions, and the formation of valleys 1640 forms machining marks 1630. Accordingly, curve 1632, which is drawn as a dashed line in FIG. 16, represents the original surface of edge 210 before forming valleys 1640 and machining marks 1630. Therefore, in this way, curve 1632 in FIG. 16 can be analogous to curve 332 in FIGS. 3 and 4. Although FIG. 16 illustrates edge 210 to include five of machining marks 1630, but edge 210 can include more or less than five of machining marks 1630.

After forming valleys 1640 and machining marks 1630, the peaks of machining marks 1630 define dashed curve 1632. The bottoms of valleys 1640 define dashed curve 1642, and curves 1632 and 1642 have radii 1631 and 1641, respectively. Machining marks 1630 and valleys 1640 in FIGS. 15 and 16 are formed using a different process than the machining marks and valleys described with reference to FIGS. 2, 3, and 5-14, but edge 210 in FIGS. 15 and 16 can still have the following characteristics:

$$radius_{1641} \geq radius_{441} + \frac{radius_{443} - radius_{441}}{\left(1 - \frac{\sqrt{2}}{\sin(angle_{453})}\sqrt{1 - \cos(angle_{453})}\right)} \quad \text{(Eq. 3)}$$

and $$radius_{1631} \geq radius_{441} + \frac{radius_{443} - radius_{441}}{\left(1 - \frac{\sqrt{2}}{\sin(angle_{453})}\sqrt{1 - \cos(angle_{453})}\right)}. \quad \text{(Eq. 4)}$$

In the same or a different embodiment, radius 441 has a length of 0.254 mm or 0.01 in., and radius 443 has a length of 0.279 mm or 0.011 in. In another embodiment, radius 441 has a length of 0.508 mm or 0.020 in., and radius 443 has a length of 0.533 mm or 0.021 in. In the same or other embodiments, radius 441 has a length that is from 0.254 mm to 0.508 mm or 0.01 in. to 0.020 in., and radius 443 has a length that is from 0.279 mm to 0.533 mm or 0.011 in. to 0.021 in.

Figure 17:
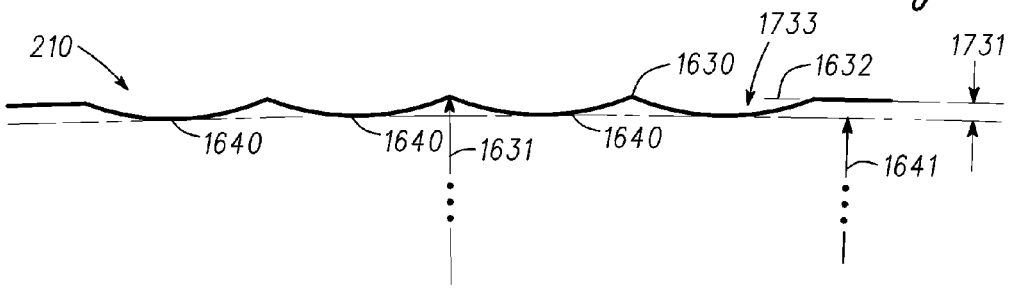
FIG. 17 depicts a simplified representation of a portion of the edge of FIG. 16, according to the tenth embodiment.

FIG. 17 depicts a simplified representation of a portion of edge 210 in FIG. 16, according to the tenth embodiment. FIG. 17 is a simplified representation because, in part, the overall shape of edge 210 is not shown to be curved, as depicted in FIG. 16. Also FIG. 17 shows only a portion of edge 210.

As depicted in FIG. 17, machining marks 1630 have height 1731, which also represents the depth of valleys 1640 from the original surface of edge 210. Portions 1733 located between two adjacent ones of machining marks 1630 are substantially smooth, substantially uniform, and substantially curved. The curves are depicted to be concave, but in another embodiment, the curve can be convex.

Figure 18:
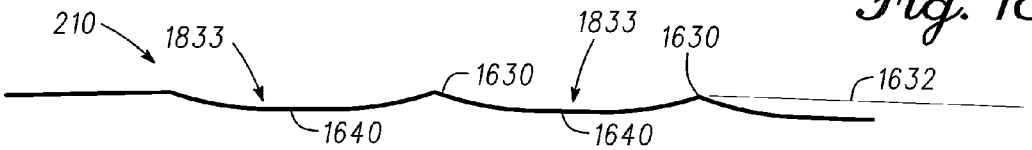
FIG. 18 depicts a simplified representation of a portion of the edge of FIG. 16, according to an eleventh embodiment.

FIG. 18 depicts another simplified representation of a portion of edge 210 in FIG. 16, according to an eleventh embodiment. FIG. 18 is similar to FIG. 17, except that adjacent ones of machining marks 1630 in FIG. 18 are spaced apart from each other by portions 1833. As an example, portions 1833 can space apart adjacent ones of machining marks 1630 by a distance of up to approximately 0.3 mm or 0.012 in. In one embodiment, adjacent ones of machining marks 1630 can be separated from each other by the same distance, or by different distances. In contrast, the distance between adjacent ones of machining marks 1630 in FIG. 17 is substantially zero. Portions 1833 in FIG. 18 can be substantially planar, or can be convexly or concavely curved or can have a different configuration.

Figure 19:
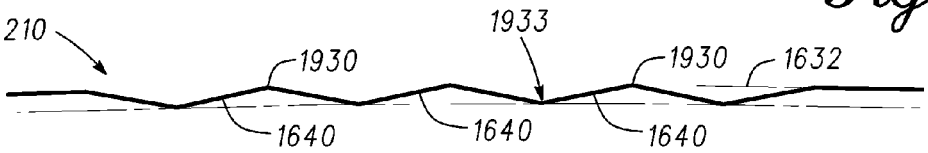
FIG. 19 depicts a simplified representation of a portion of the edge of FIG. 16, according to a twelfth embodiment.

FIG. 19 depicts another simplified representation of a portion of edge 210 of FIG. 16, according to a twelfth embodiment. FIG. 19 is similar to FIG. 17, except that FIG. 19 depicts machining marks 1930, which have substantially straight sides instead of the concave sides of machining marks 1630 in FIG. 17. Also, in FIG. 19, portions 1933 are located between adjacent ones of machining marks 730 and have an overall V-shape.

Figure 20:
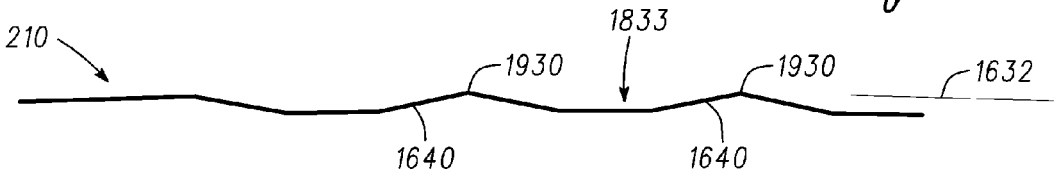
FIG. 20 depicts a simplified representation of a portion of the edge of FIG. 16, according to a thirteenth embodiment.

FIG. 20 depicts another simplified representation of a portion of edge 210 of FIG. 16, according to a thirteenth embodiment. FIG. 20 is similar to FIG. 19, except that adjacent ones of machining marks 1930 in FIG. 20 are spaced apart from each other by portions 1833.

FIG. 21 depicts another simplified representation of a portion of edge 210 of FIG. 16, according to a fourteenth embodiment. FIG. 21 is similar to FIG. 17, except that FIG. 21 depicts machining marks 2130, which have curved top surfaces or rounded peaks instead of the pointed peaks of machining marks 1630 in FIG. 17. In a different embodiment, adjacent ones of machining marks 2130 can be separated by portions 1833 (FIG. 18) of edge 210.

FIG. 22 depicts another simplified representation of a portion of edge 210 of FIG. 16, according to a fifteenth embodiment. FIG. 22 is similar to FIG. 18, except that FIG. 22 depicts machining marks 2230, which are substantially rectangularly shaped and have a substantially planar top surface. In a different embodiment, machining marks 2230 can have rounded top surfaces, which can be concentric or parallel with curve 1632.

FIG. 23 depicts another simplified representation of a portion of edge 210 of FIG. 16, according to a sixteenth embodiment. FIG. 23 is also similar to FIG. 18, except that FIG. 23 depicts machining marks 2330, which are substantially trapezoidally shaped and have a substantially planar top surface. In a different embodiment, adjacent ones of machining marks 2330 can be contiguous with each other, and/or machining marks 2330 can have rounded top surfaces, which can be concentric or parallel with curve 1632.

FIG. 24 depicts another simplified representation of a portion of edge 210 of FIG. 16, according to an seventeenth embodiment. FIG. 24 is similar to FIG. 19, except that FIG. 24 depicts machining marks 2430, which have curved top surfaces or rounded peaks. Machining marks 2430 in FIG. 24 can be similar to machining marks 1230 in FIG. 12. Other variations to machining marks 1630 (FIGS. 16 and 17) are also contemplated herein.

FIG. 25 depicts method 2500 of manufacturing a golf club, according to an eighteenth embodiment. Method 2500 includes forming a strike face comprising one or more grooves having edges, where an edge of at least one of the one or more grooves is unsmooth (a block 2510). In one embodiment, block 2510 could include casting the strike face with the grooves and the unsmooth edge or edges. In a different embodiment, block 2510 could include casting the strike face with the grooves and, afterwards, machining, micromachining, and/or growing the edges to make them unsmooth. For example, micromachining the edges can include micromachining projections into the edges. In another embodiment, block 2510 could include casting the strike face without the grooves and, afterwards, machining or micromachining the grooves into the strike face and then machining, micromachining, or growing the edges to make them unsmooth. In a further embodiment, block 2510 could include casting the strike face without the grooves and, afterwards, machining or micromachining the grooves into the strike face. As an example, machining or micromachining the edges can include electrical discharge machining or laser peening the grooves into the face and, afterwards, not buffing or otherwise finishing the face, not fully buffing or finishing the face, or minimizing the amount of buffing or finishing of the face to maintain at least a portion of the machining marks of the grooves. The machining or micromachining can be controlled to provide the machining marks within the specifications identified above. In an additional embodiment, the casting process identified above can be replaced with a forging process and/or a machining process. In another embodiment, the growing process identified above can include an epitaxial growing process. In a further embodiment, the laser peening process can be used to create the machining marks after machining the grooves into the face. Block 2510 can be used to form the projections in the edges of the grooves, regardless of whether the projections are similar to the projections of: (a) FIGS. 2, 3, and 5-12; (b) FIGS. 13-14; or (c) FIGS. 15-24.

Method 2500 can continue with forming a golf club head body (a block 2520). The forming process of block 2520 could also include casting, forging, and/or micromachining. In some embodiments, blocks 2510 and 2520 can be performed in a reverse sequence or simultaneously with each other. In an embodiment where blocks 2510 and 2520 are performed separately, method 2500 includes coupling the strike face to the golf club head body (a block 2530). In an embodiment where blocks 2510 and 2520 are performed simultaneously, the strike face is integral with the golf club head body, and block 2530 can be omitted from method 2500. In this embodiment, however, the edges of the grooves could still be made unsmooth after or while casting the entire golf club head body.

Method 2500 continues with coupling a shaft to the golf club head body (a block 2540). As explained above, the shaft can be coupled to a hole in the golf club head body or to a hosel of the golf club head body.

Figure 26:
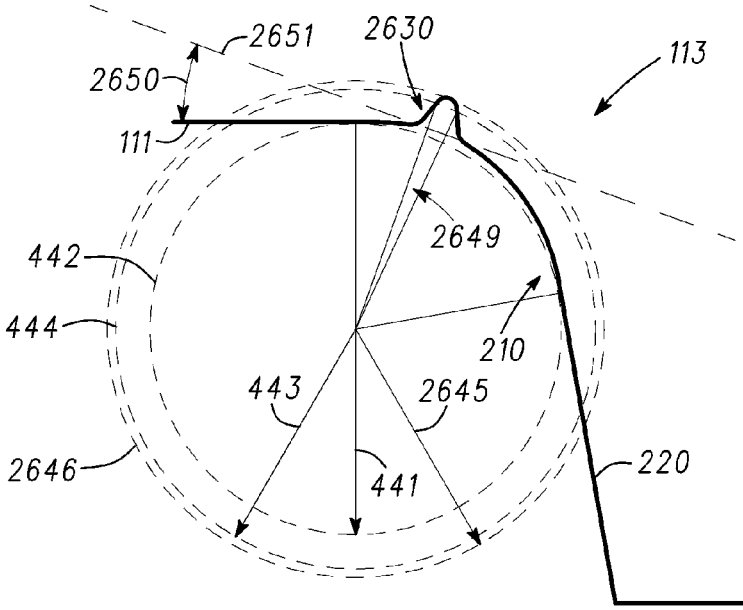
FIG. 26 depicts an edge of a groove of the golf club of FIG. 1, according to a nineteenth embodiment.

Turning to the next figure, FIG. 26 depicts edge 210 of groove 113 of FIG. 1, according to a nineteenth embodiment. The view illustrated in FIG. 26 is similar to the view illustrated in FIG. 4 of a different embodiment of edge 210 of groove 113. In FIG. 26, protrusion 2630 is located at edge 210. Protrusion 2630 can be similar to machining marks 330 in FIG. 3 and/or any of the other machining marks previously described for edge 210. As used herein, the term protrusions includes machining marks. In the embodiment of FIG. 26, edge 210 comprises a single one of protrusion 2630, but in other embodiments, edge 210 can comprise more than one of protrusion 2630.

In the embodiment where radius 441 has a length of 0.254 mm or 0.010 in. and where radius 443 has a length of 0.279 mm or 0.011 in., protrusion 2630 extends from edge 210 to beyond circle 444 having radius 443, as illustrated in FIG. 26. FIG. 26 also illustrates circle 2646 having radius 2645 that is greater than radii 441 and 443. In one embodiment, radius 2645 can extend up to 0.00762 mm or 0.0003 in. beyond radius 443 so that radius 2645 has a maximum length of 0.287 mm or 0.0113 in. In this embodiment, protrusion 2630 extends beyond circle 444 to circle 2646 and, therefore, has a height measured radially from edge 210 to circle 2646. In a different embodiment, protrusion 2630 can extend beyond circle 444, but does not extend all the way to circle 2646. In the same or different embodiment, protrusion 2630 extends beyond circle 444 by more than 0.00762 mm or 0.0003 in.

FIG. 26 also illustrates angle 2649 defined by: (1) a radius of circle 444 that is defined by a first region of edge 210 that intersects circle 444; and (2) a radius of circle 444 that is defined by a second region of edge 210 that intersects circle 444. In one embodiment, angle 2649 is less than or equal to ten degrees.

In other embodiments, angle 2649 can be greater than 10 degrees. As an example, angle 2649 can be greater than 10 degrees on less than fifty percent (50%) of edges 210 of grooves 112 (FIG. 1) of front face 111 (FIG. 1) and can be greater than 10 degrees on less than half of edges 211 (FIG. 2) of grooves 112 (FIG. 1) of front face 111 (FIG. 1).

In one embodiment, a line that is tangent to a part or any part of the portion of edge 210 where protrusion 2630 is located does not form a thirty degree angle with front face 111. Therefore, as illustrated in FIG. 26, tangent line 2651 forms an angle 2650 with front face 111, and angle 2650 is less than thirty degrees. In one example, protrusion 2630 is at a portion of edge 210 that is as close to front face 111 as possible such that angle 2650 is as small as possible. In this example, protrusion 2630 can extend above front face 111, or protrusion 2630 can extend up to front face 111. In another embodiment, protrusion 2630 is further away from front face 111 such that angle 2650 is greater than thirty degrees. In a different embodiment, protrusion 2630 is at a portion of edge 210 such that tangent line 2651 forms angle 2650 to be equal to thirty degrees.

Protrusion 2630 can be a portion of each groove of a golf club head, or can be a portion of only some of the grooves of a golf club head. Also, protrusion 2630 can be at the same location for each groove in the golf club head, or protrusion 2630 can be at different locations for different grooves within the same golf club head.

Protrusions 2630 can also be at the same location for each groove in a particular golf club head, but can be at different locations within the grooves of different golf club heads. For example, the location of protrusion 2630 at edge 210 can be based on the loft angle of front face 111. In particular, protrusion 2630 can be located at edge 210 closer to front face 111 when front face 111 has a higher loft angle, and protrusion 2630 can be located at edge 210 further away from front face 111 and closer to sidewall 220 when front face 111 has a lower loft angle. In an different embodiment, protrusion 2630 can be located at edge 210 closer to front face 111 when front face 111 has a lower loft angle and further away from front face 111 when front face 111 has a higher loft angle. Additionally, protrusion 2630 can have different shapes and/or heights based on the loft angle of front face 111 (e.g., a larger, taller, and/or sharper shape for a larger loft angle in one embodiment, or a larger, taller, and/or sharper shape for a smaller loft angle in a different embodiment). Moreover, the grooves can have a different quantity of protrusions based on the loft angle of front face 111 (e.g., more protrusions for a larger loft angle in one embodiment, or more protrusions for a smaller loft angle in a different embodiment).

As illustrated in the embodiment of FIG. 26, sidewall 220 has a steep slope such that the cross sectional shape of groove 113 is closer to a U-shape than a V-shape. In a different embodiment, sidewall 220 has a more gradual slope such that the cross sectional shape of groove 113 is closer to a V-shape than a U-shape. In either embodiment, sidewall 220 can be straight and/or curved.

As described above for FIG. 4, the characteristics of edge 210 can also be present for edge 211 (FIG. 2) of groove 113 such that groove 113 is symmetric. In a different embodiment, only one of edges 210 and 211 can have the characteristics described above for edge 210 in FIG. 26. In a first example of this different embodiment, groove 113 can be asymmetric, and in a second example of this different embodiment, groove 113 can still be symmetric to the naked eye because of the small size of protrusion 2630. In an embodiment where only one of edges 210 and 211 have protrusion 2630, the edge that is closer to the top rail of the golf club head can have the protrusion while the edge that is closer to the bottom rail or sole of the golf club head can be without the protrusion. This embodiment can further increase the grip that front face 111 has on a golf ball when front face 111 impacts the golf ball. Again, as a result of the increased or improved grip, the golf ball can, under certain conditions, have a higher rate of backspin, which can, under certain conditions, improve the consistency of a golf shot from the golf club in a variety of playing conditions.

Figure 27:
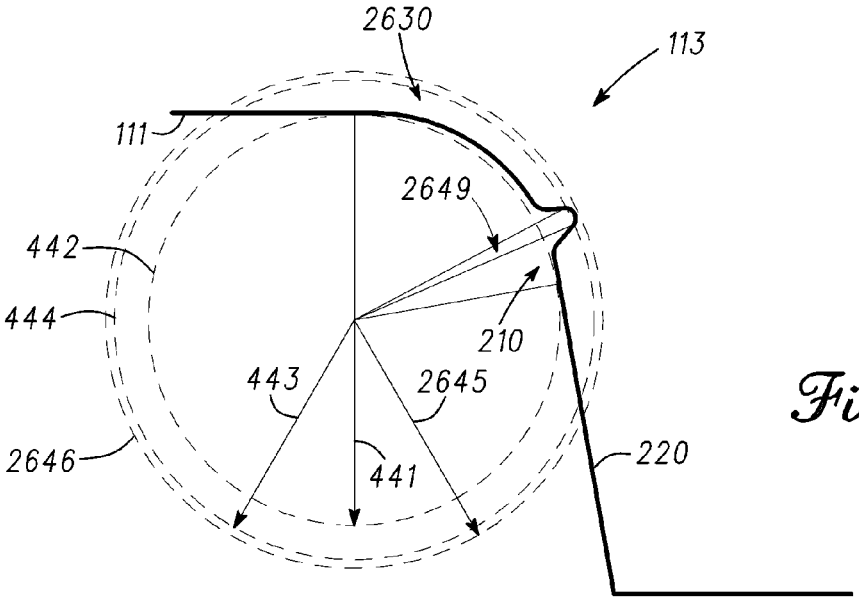
FIG. 27 depicts an edge of a groove of the golf club of FIG. 1, according to a twentieth embodiment.

FIG. 27 depicts edge 210 of groove 113 of the golf club of FIG. 1, according to a twentieth embodiment. In the embodiment of FIG. 27, protrusion 2730 is located at edge 210. Protrusion 2730 can be similar to protrusion 2630 in FIG. 26 and, therefore, can also be similar to machining marks 330 in FIG. 3 and/or any of the other machining marks or other protrusions previously described for edge 210. In FIG. 27, edge 210 comprises a single one of protrusion 2730, but in other embodiments, edge 210 can comprise more than one of protrusion 2730.

Protrusion 2730 in FIG. 27 is located closer to sidewall 220 and further away from front face 111 than protrusion 2630 in FIG. 26. As explained previously with respect to FIG. 26, the embodiment of FIG. 27 can be used when front face 111 has a lower loft angle (or vice versa) compared to front face 111 in the embodiment of FIG. 26. A line that is tangent to a part of the portion of edge 210 where protrusion 2630 is located can form an angle with front face 111 that is greater than thirty degrees.

Figure 28:
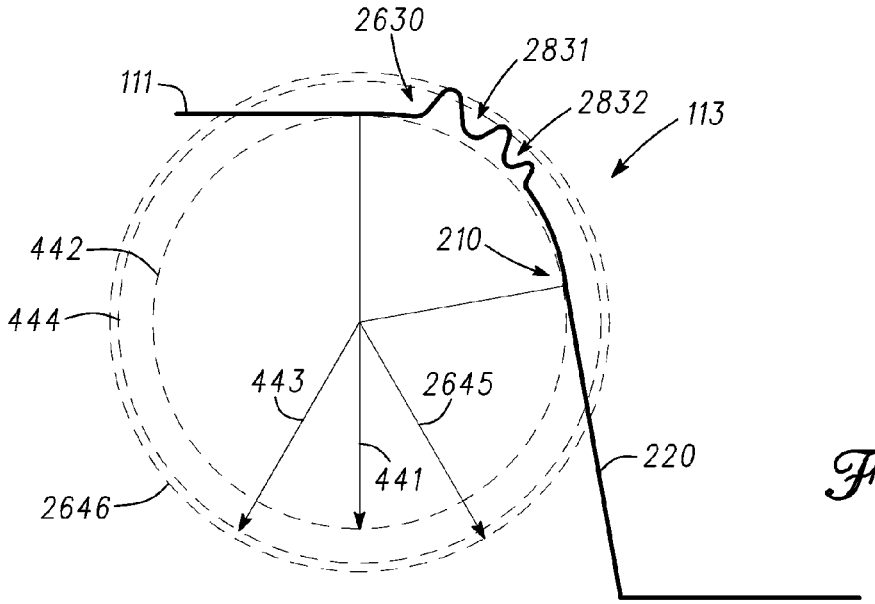
FIG. 28 depicts an edge of a groove of the golf club of FIG. 1, according to a twenty-first embodiment.

FIG. 28 depicts edge 210 of groove 113 of the golf club of FIG. 1, according to a twenty-first embodiment. In the embodiment of FIG. 28, edge 210 comprises more than one protrusion. In particular, edge 210 comprises protrusions 2630, 2831, and 2832. In a different embodiment, edge 210 can include less than or more than three protrusions.

Protrusions 2831 and 2832 can be similar to protrusion 2630, but can have different shapes and/or sizes. As an example, in the embodiment of FIG. 28, protrusions 2831 and 2832 are shorter than, but are proportional to, protrusion 2630. Also, protrusion 2832 is also shorter than protrusion 2831, and protrusions 2831 and 2832 are located closer to sidewall 220 than protrusion 2630 such that the height of each of protrusions 2630, 2831, and 2832 sequentially decreases towards sidewall 220, as illustrated in FIG. 28 In the same or different embodiment, the spacing between protrusions 2630, 2831, and 2832 can be consistent or can vary. Additionally, in the same or different embodiment, protrusions 2831 and 2832 can be shorter than and non-proportional to protrusion 2630. In a different embodiment, each of protrusions 2831 and 2832 can be the same height as protrusion 2630, or one or more of protrusions 2831 and 2832 can be shorter than protrusion 2630, but can have heights between circles 444 and 2646.

Figure 29:
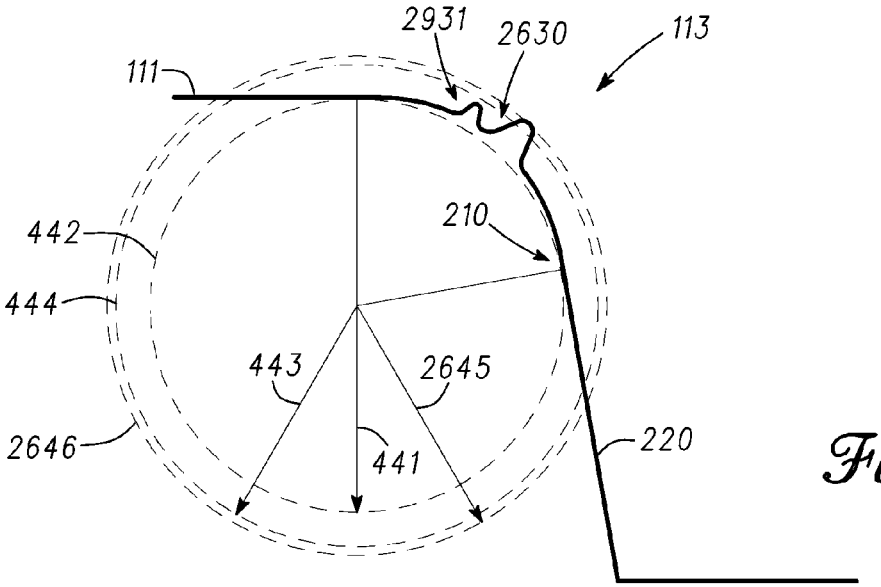
FIG. 29 depicts an edge of a groove of the golf club of FIG. 1, according to a twenty-second embodiment.

FIG. 29 depicts edge 210 of groove 113 of the golf club of FIG. 1, according to a twenty-second embodiment. In the embodiment of FIG. 29, edge 210 also comprises more than one protrusion. In particular, edge 210 comprises protrusions 2630 and 2931. In a different embodiment, edge 210 can include more than two protrusions.

Protrusion 2931 can be similar to protrusion 2630, but can have a different shape and/or size. As an example, in the embodiment of FIG. 29, protrusion 2931 is shorter than, but is proportional to, protrusion 2630. Also, protrusion 2931 is closer to front face 111 than protrusion 2630 such that the height of each of protrusions 2630 and 2931 sequentially decreases towards front face 111, as illustrated in FIG. 29. In a different embodiment, protrusion 2931 can be shorter than and non-proportional to protrusion 2630. In another embodiment, protrusions 2931 can be the same height as protrusion 2630, or protrusion 2931 can be shorter than protrusion 2630, but can have a height between circles 444 and 2646.

Figure 30:
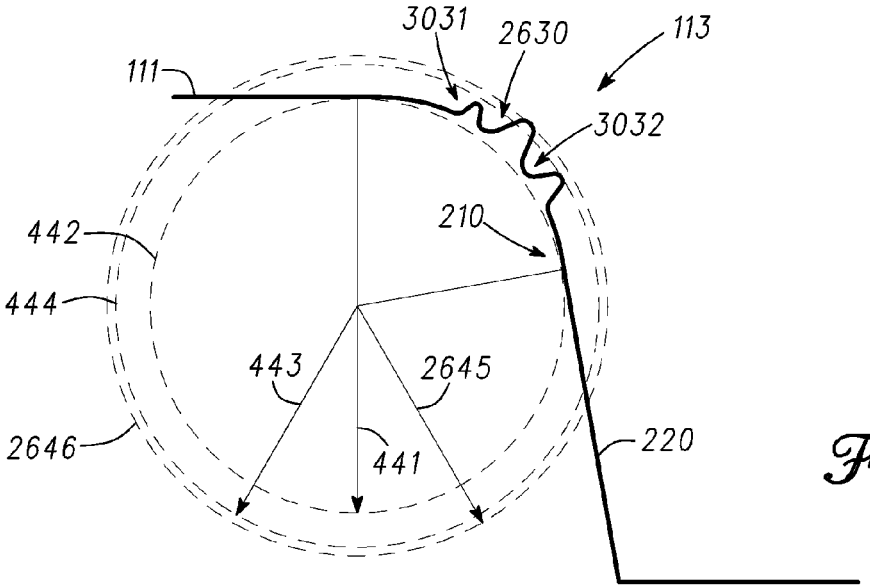
FIG. 30 depicts an edge of a groove of the golf club of FIG. 1, according to a twenty-third embodiment.

FIG. 30 depicts edge 210 of groove 113 of the golf club of FIG. 1, according to a twenty-third embodiment. The embodiment of FIG. 30 can be similar to a combination of the embodiments of FIGS. 28 and 29. For example, edge 210 comprises more than one protrusion, namely, protrusions 2630, 3031, and 3032.

Protrusions 3031 and 3032 can be similar to protrusion 2630, but can have different shapes and/or sizes. As an example, in the embodiment of FIG. 30, protrusion 3032 is shorter than protrusion 2630, and protrusion 3031 is shorter than protrusion 3032. In a different embodiment, the relative heights of protrusions 3031 and 3032 can be reversed or otherwise changed, and/or edge 210 can include a different number of protrusions on either side of protrusion 2630. In the same or different embodiment, the spacing between protrusions 2630, 3031, and 3032 can be consistent or can vary. Furthermore, the concepts related to the additional protrusions described with respect to protrusion 2630 in the embodiments of FIGS. 28, 29, and 30 can also be applied to protrusion 2730 and the embodiment of FIG. 27.

Figure 31:
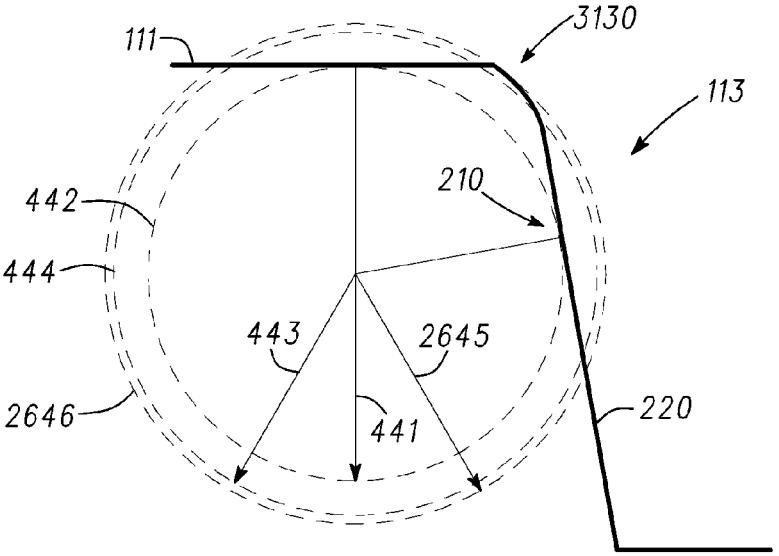
FIG. 31 depicts an edge of a groove of the golf club of FIG. 1, according to a twenty-fourth embodiment.

FIG. 31 depicts edge 210 of groove 113 of the golf club of FIG. 1, according to a twenty-fourth embodiment. In the embodiment of FIG. 31, protrusion 3130 is located at edge 210. Protrusion 3130 can be similar to protrusion 2630 in FIG. 26, but in the illustrated embodiments, protrusion 3130 is much smaller than protrusion 2630 in FIG. 26. In other embodiments, protrusion 2630 can be more similar in size to protrusion 2630 (FIG. 26). In FIG. 31, edge 210 comprises a single one of protrusion 3130, but in other embodiments, edge 210 can comprise more than one of protrusion 3130. Also in FIG. 31, at least a portion of protrusion 3130 is located between circles 444 and 2646, but in other embodiments, protrusion 3130 can be located only between circles 442 and 444.

Protrusion 3130 is located at the edge of edge 210 or at the border or interface between front face 111 and edge 210. To manufacture protrusion 3130 and/or other protrusions described herein, groove 113 (including edges 210 and 211 (FIG. 2), sidewalls 220 and 221 (FIG. 2), and bottom 230) can be machined into front face 111. The process of machining groove 113 into front face 111 can form protrusion 3130. As an example, protrusion 3130 can be formed while using a drill bit to form groove 113 into front face 111. In this example, protrusion 3130 can be considered a manufacturing artifact or a machining mark. Protrusion 3130 can also be referred to as a discontinuity between front face 111 and edge 210. To maintain the small size of protrusion 3130, a buffing or other finishing process for front face 111 and/or grooves 113 that occurs after machining grooves 113 can be omitted. As a result, this manufacturing process can be faster than other processes using the post-machining buffing process.

Figure 32:
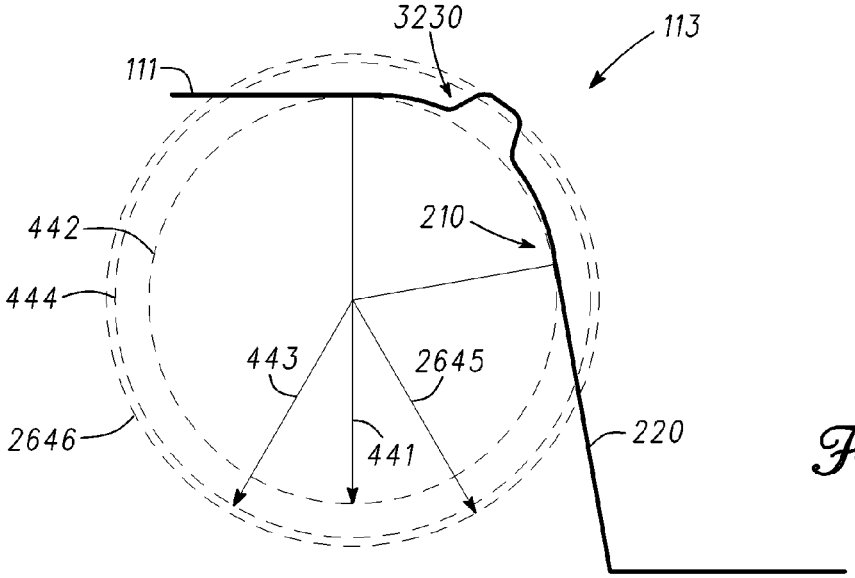
FIG. 32 depicts an edge of a groove of the golf club of FIG. 1, according to a twenty-fifth embodiment.

Turning to the next figure, FIG. 32 depicts edge 210 of groove 113 of the golf club of FIG. 1, according to a twenty-sixth embodiment. In the embodiment of FIG. 32, protrusion 3230 is located at edge 210. Protrusion 3230 can be similar to protrusion 2630 in FIG. 26. In FIG. 32, edge 210 comprises a single one of protrusion 3230, but in other embodiments, edge 210 can comprise more than one of protrusion 3230.

Circle 442 is closer to edge 210 in FIG. 32 than edge 210 in FIG. 26. Therefore, protrusion 3230 in FIG. 32 can be higher or taller than protrusion 2630 in FIG. 26, when the protrusions are measured from their respective edges. As an example, protrusion 3230 can have a maximum height of approximately 0.262 mm or 0.0103 in., as measured radially from edge 210.

Figure 33:
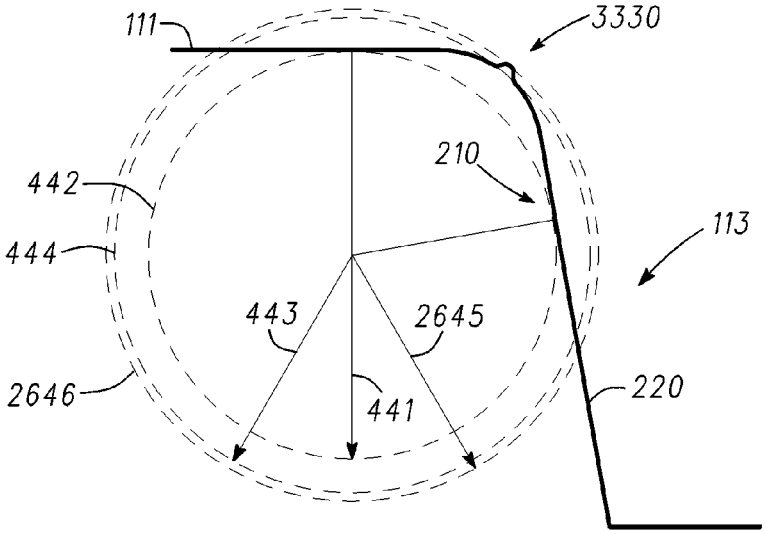
FIG. 33 depicts an edge of a groove of the golf club of FIG. 1, according to a twenty-sixth embodiment.

FIG. 33 depicts edge 210 of groove 113 of the golf club of FIG. 1, according to a twenty-seventh embodiment. In the embodiment of FIG. 33, protrusion 3330 is located at edge 210. Protrusion 3330 can be similar to protrusion 2630 in FIG. 26. In FIG. 33, edge comprises a single one of protrusion 3330, but in other embodiments, edge 210 can comprise more than one of protrusion 3330.

Circle 444 is closer to edge 210 in FIG. 33 than edge 210 in FIG. 26. Therefore, edge 210 in FIG. 33 will be larger or more pronounced than edge 210 in FIG. 26. in this embodiment, protrusion 3330 can have a maximum height of 0.0076 mm or 0.0003 in.

The disclosure of embodiments of golf clubs and methods of manufacture is intended to be illustrative of the scope of golf clubs and methods of manufacture and is not intended to be limiting. For example, the details of the grooves described with reference to FIGS. 1-33 can be applied to not only irons, but also drivers and other woods, hybrid clubs, putters, and other types of golf clubs. Furthermore, the machining marks or other protrusions at a single edge of a groove can be evenly or unevenly spaced apart from each other, or the density, size, and/or shape of the machining marks or other protrusions can be different at different parts of the same groove. Moreover, the machining marks or other protrusions do not need to extend along the length of the groove. Instead, the machining marks or other protrusions can be more similar to intermittent machining marks or protrusions, or bumps, or punch marks, or other smaller sized machining marks or other protrusions. Additionally or instead, the machining marks or other protrusions can be curved, bent, crooked, etc. As another example, front face 111 can also be unsmooth and have machining marks or other protrusions. Still further, the unsmooth edges of grooves can be implemented for only certain clubs within a set of golf clubs to adjust or otherwise customize the golf clubs for a particular golfer. For example, in one embodiment, only the groove edges of the sand wedge and the pitching wedge are unsmooth. In another embodiment, if a golfer has problems creating backspin on the golf ball under certain conditions with his lower numbered irons (i.e., a 2-iron, a 3-iron, and a 4-iron), then only the groove edges of those lower number irons can be unsmooth.

Furthermore, the golf clubs and methods of manufacture discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of golf clubs and methods of manufacture, and may disclose alternative embodiments of golf clubs and methods of manufacture. It is intended that the scope of golf clubs and methods of manufacture shall be defined by the appended claims.

All elements claimed in any particular claim are essential to golf clubs or methods of manufacture claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A method of manufacturing a golf club head, the method comprising:
providing a golf club head body;
providing a shaft;
providing a strike face;
forming one or more grooves at the strike face;
coupling the strike face to the golf club head body; and
coupling the shaft to the golf club head body;
wherein:
the one or more grooves have edges; and
one or more of the edges is unsmooth having peaks and valleys.

2. The method of claim 1 wherein:
forming the one or more grooves at the strike face comprises:
forming the peaks and valleys of the one or more edges; and
forming sidewalls of the one or more grooves adjacent to the edges;
wherein:
the peaks and valleys are located at the edges and are absent from the sidewalls.

3. The method of claim 1 wherein:
forming the one or more grooves at the strike face comprises:
forming the peaks and valleys of the one or more edges such that a distance between two adjacent peaks is approximately 0.254 millimeters.

4. The method of claim 3 wherein:
a portion of the one or more edges located between the two adjacent peaks is substantially smooth.

5. The method of claim 3 wherein:
a portion of the one or more edges located between the two adjacent peaks is substantially curved, is substantially planer, or has an overall V-shape.

6. The method of claim 1 wherein:
forming the one or more grooves at the strike face comprises:
forming the peaks and valleys of the one or more edges;
wherein:
the peaks have substantially planar top surfaces.

7. The method of claim 1 wherein:
forming the one or more grooves at the strike face comprises:
forming the one or more grooves so the one or more grooves are symmetric.

8. The method of claim 1 wherein:
forming the one or more grooves at the strike face comprises:
forming peaks and valleys of the one or more edges;
forming a first radius of curvature is defined by the peaks on the one or more edges; and
forming a second radius of curvature is defined by bottom portions of the valleys on the one or more edges.

9. The method of claim 8 wherein:
forming the first radius of curvature defined by the peaks and forming the second radius of curvature defined by the bottom portions of the valleys are both have an effective radius greater than or equal to approximately 0.254 millimeters.

10. The method of claim 8 wherein:
forming the first radius of curvature defined by the peaks and forming the second radius of curvature defined by the bottom portions of the valleys are both have an effective radius greater than or equal to approximately 1.016 millimeters.

11. The method of claim 8 wherein:
forming the first radius of curvature defined by the peaks and forming the second radius of curvature defined by the bottom portions of the valleys, wherein the peaks and valleys comprise a height measured from the first radius of curvature to the second radius of curvature, and the height is approximately 0.0127 millimeter to 0.0508 millimeter.

12. The method of claim 8 wherein:
forming the first radius of curvature defined by the peaks and forming the second radius of curvature defined by the bottom portions of the valleys, wherein the peaks and valleys comprise a height measured from the first radius of curvature to the second radius of curvature, and the height is approximately 0.0254.

13. The method of claim 8 wherein:
forming the first radius of curvature defined by the peaks and forming the second radius of curvature defined by the bottom portions of the valleys;
wherein
the peaks and valleys comprise:
a height defined as the distance from the first radius of curvature to the second radius of curvature; and
a width defined as the distance between two adjacent peaks;
wherein
a ratio of the height to the width is 1:10 or greater.

14. The method of claim 1 wherein:
forming the peaks and valleys of the one or more edges comprise straight sides, wherein the peaks and valleys are substantially parallel to the one or more grooves.

15. The method of claim 1 wherein:
forming the peaks and valleys of the one or more edges comprise straight sides, wherein the peaks and valleys are not substantially parallel to the one or more grooves.

16. The method of claim 1 wherein:
forming the one or more grooves at the strike face comprises:
forming the peaks and valleys of the one or more edges such that a distance between two adjacent peaks of is less than 0.254 millimeters.

17. A method of manufacturing a golf club head, the method comprising:
providing a golf club head body;
providing a shaft:

providing a strike face;

forming one or more grooves at the strike face;

coupling the strike face to the golf club head body; and coupling the shaft to the golf club head body;

wherein:

the one or more grooves have edges;

one or more of the edges is unsmooth having peaks and valleys;

forming the one or more grooves at the strike face comprises:

forming the peaks and valleys of the one or more edges; and forming sidewalls of the one or more grooves adjacent to the edges; and at least one of: (i) the peaks and valleys are located at the edges and are absent from the sidewalls, (ii) the peaks and valleys comprise a height defined by a distance from the valley to the peak of approximately 0.0127 millimeters to 0.0508 millimeters, or (iii) the one or more edges have an effective radius greater than or equal to approximately 1.016 millimeters.

18. The method of claim 17 wherein:

providing the strike face comprises forming the strike face.

19. The method of claim 17 wherein:

forming the one or more grooves at the strike face comprises machining the one or more grooves at the strike face.

* * * * *